US006640848B1

(12) United States Patent
McIsaac et al.

(10) Patent No.: US 6,640,848 B1
(45) Date of Patent: Nov. 4, 2003

(54) MULTIOUTLET DEPOSITOR

(76) Inventors: John McIsaac, 27 Amilton Ave., Dedham, MA (US) 02026; Adam Wozniak, 24 Bowditch St., Peabody, MA (US) 01960

( * ) Notice: Subject to any disclaimer, the term of this patent is extended or adjusted under 35 U.S.C. 154(b) by 0 days.

(21) Appl. No.: 10/064,304

(22) Filed: Jul. 1, 2002

(51) Int. Cl.[7] ..... B65B 1/04
(52) U.S. Cl. ..... 141/237; 141/125; 426/125
(58) Field of Search ..... 141/234, 236, 141/237, 125; 137/318, 883, 884; 426/125; 222/22, 482, 485

(56) References Cited

U.S. PATENT DOCUMENTS 3,695,486 A * 10/1972 Warner ..... 222/162
4,830,236 A * 5/1989 Broll et al. ..... 222/485
5,289,954 A * 3/1994 Bruggendick et al. ..... 222/409
6,374,873 B1 * 4/2002 Price et al. ..... 141/238

* cited by examiner

*Primary Examiner*—Steven O. Douglas
(74) *Attorney, Agent, or Firm*—Richard A. Joel, Esq.

(57) ABSTRACT

An apparatus for the portioning and depositing of food products in form/fill/seal machines and other food packaging machinery into pockets that are then evacuated and sealed. A food pump outlet is connected to a manifold which has a number of outlets corresponding to positions over the pockets. A cutoff knife blocks the flow from each outlet. A programmable logic controller activates a first knife causing it to open with a single accurate portion of food product being pumped through the outlet and then cut cleanly by the knife. The operation continues for the remaining pockets which are provided with a single distinct and accurate portion for each pocket. Optionally, a double cut operation may be programmed into the logic controller. Once the pockets are full, the controller signals the packaging machine to index.

9 Claims, 3 Drawing Sheets

MULTIOUTLET DEPOSITOR

BACKGROUND OF INVENTION

The present invention relates to an apparatus for the portioning and depositing of food products in form/fill/seal machines or tray sealing machines and particularly to an apparatus that provides simultaneous scaling and portioning of food products into pockets.

In the packaging industry, horizontal form/fill/seal machines are often used to package food products. During each cycle or index, pockets are simultaneously formed from a roll of film, filled with food products, evacuated and sealed. The pockets which generally range in number from one to eight are loaded during each index of the machine. The most common method of loading is by hand although machines such as an indexing conveyor, a drop chute or, in case of liquid products, a simple piston filler.

The product scaling to provide accurate weight portions is generally done before loading as a separate operation. This is particularly the case with raw meat products especially chicken. Raw chicken is extremely difficult to cut due to sinew. If one "string" remains uncut, a piece of meat will hang on resulting in an off weight portion and seal contamination.

In the past, multiple outlet depositors that are designed to fill all of the pockets simultaneously have attempted simultaneous scaling and portioning. A pump such as the Vemag pump manufactured by Robert Reiser & Co., Inc. of Canton, Mass., may be used to move the food stream and a device is then used to divide the stream into particular weight portions. However, the portions must now be cut simultaneously and weight control involves another variable, the flow divider. This is a serious problem.

The state of the prior art is shown in patents such as U.S. Pat. No. 6,212,861 to Tsuruta on a Forming, Filling and Sealing Machine for Standing Pouch and U.S. Pat. No. 6,058,680 to Meile, et al on a Method and Apparatus for Forming and Hermetically Sealing Slices of Food Items. Also of interest are U.S. Pat. No. 5,155,969 to Kue and U.S. Pat. No. 4,997,664 to Williams. The prior art fails to disclose an apparatus of the type disclosed herein which simultaneously scales and portions food products into pockets.

SUMMARY OF INVENTION

The invention relates to a multi outlet depositor and particularly to an apparatus for the portioning and depositing of food products in form/fill/seal machines. In addition to filling the pockets of a horizontal form/fill/seal machine the device may also be used with other packaging machines such as a preformed tray-sealing machine. In this instance the trays are preformed and placed into carriers. Once the food is in the tray, the tray can be evacuated and sealed with film. The apparatus provides simultaneous scaling and positioning of food products into pockets that are then evacuated and sealed.

In addition to filling the pockets of a horizontal form/fill/seal machine the device may also be used with other packaging machines such as a preformed tray-sealing machine. In this instance the trays are preformed and placed into carriers. Once the food is in the tray, the tray can be evacuated and sealed with film.

A commercially available pump such as the previously cited Vemag by Robert Reiser & Co., Inc., which operates as a filler, portions once for each pocket to be filled. The Vemag or filler outlet is attached to a single cylindrical open manifold. The manifold has a number of outlets that correspond to positions over the pockets. A pneumatically driven cutoff knife is mounted at each outlet of the manifold.

The knives start in a down position blocking off flow from the manifold outlets. When the packaging machine indexes to its next position, a signal is sent to a programmable logic controller or PLC. The PLC starts a series of operations that comprise a first knife opening at an outlet, the Vemag pumping a single accurate portion of food product and the knife coming down and cutting off the portion cleanly. Then the next knife opens, the Vemag portions and the knife comes down and cuts off the portion cleanly. This operation continues for the remaining pockets. Once the pockets are filled, the PLC signals the packaging machine that it can index. Thus, the knives provide a single distinct and accurate portion for each pocket.

With the above multi outlet depositor, a source of error is eliminated and, because there is no restriction from a flow divider, the product integrity is improved. The product does not break down and there are larger identifiable pieces of product which is extremely desirable. Weight accuracy is also increased by a double cut with the knives, which involves a knife traveling back up for a portion of its travel after a cut and then closing again to insure that anything that has stuck to a knife will fall into a pocket.

Accordingly, an object of this invention is to provide a new and improved method and apparatus for portioning and depositing food products in form/fill/seal machines and other food packaging machinery.

Another object of this invention is to provide a new and improved method and apparatus for simultaneous scaling and portioning of food products into pockets.

A further object of this invention is to provide a new and improved method and apparatus for depositing food products in pockets on a form/fill/seal machine and other food packaging machinery which portions once for each pocket to be filled.

A still further object of this invention is to provide a new and improved method and apparatus for feeding food products through a plurality of separate manifold outlets blocked by knives which sequentially open and close in a double cut action to precisely portion the product into a series of pockets.

A more specific object of this invention is to provide a new and improved method and apparatus for depositing food products into pockets which comprises a plurality of food manifold outlets with knives which sequentially block and open to portion food products into pockets in accordance with signals from a programmable logic controller.

BRIEF DESCRIPTION OF DRAWINGS

The above and other objects of the invention may be more readily seen when viewing in conjunction with the accompanying drawings wherein.

FIG. 2 is a partially exploded view of the apparatus of FIG. 1; and.

DETAILED DESCRIPTION

Figure 1:
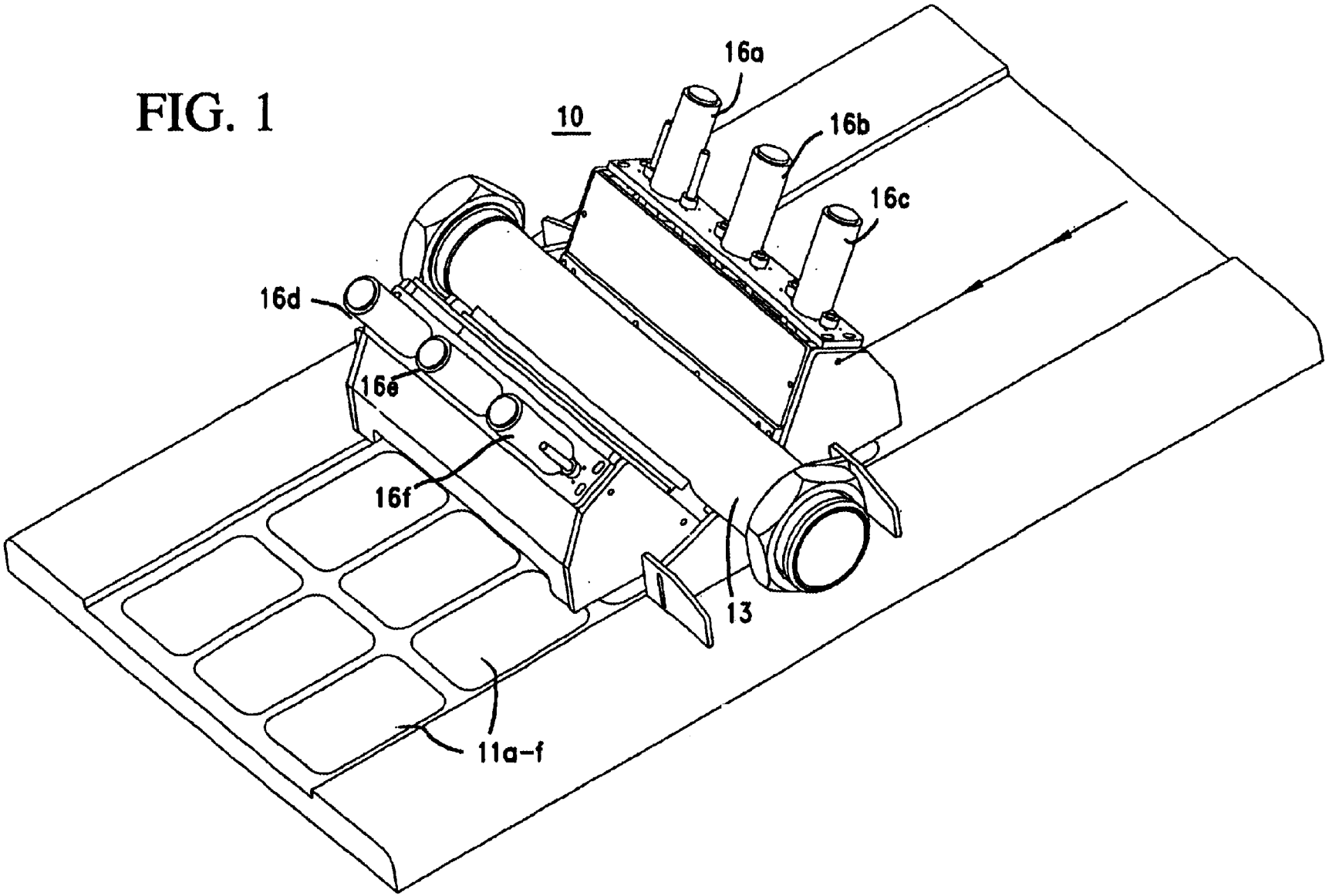
FIG. 1 is a perspective view of the apparatus comprising the invention.
Figure 2:
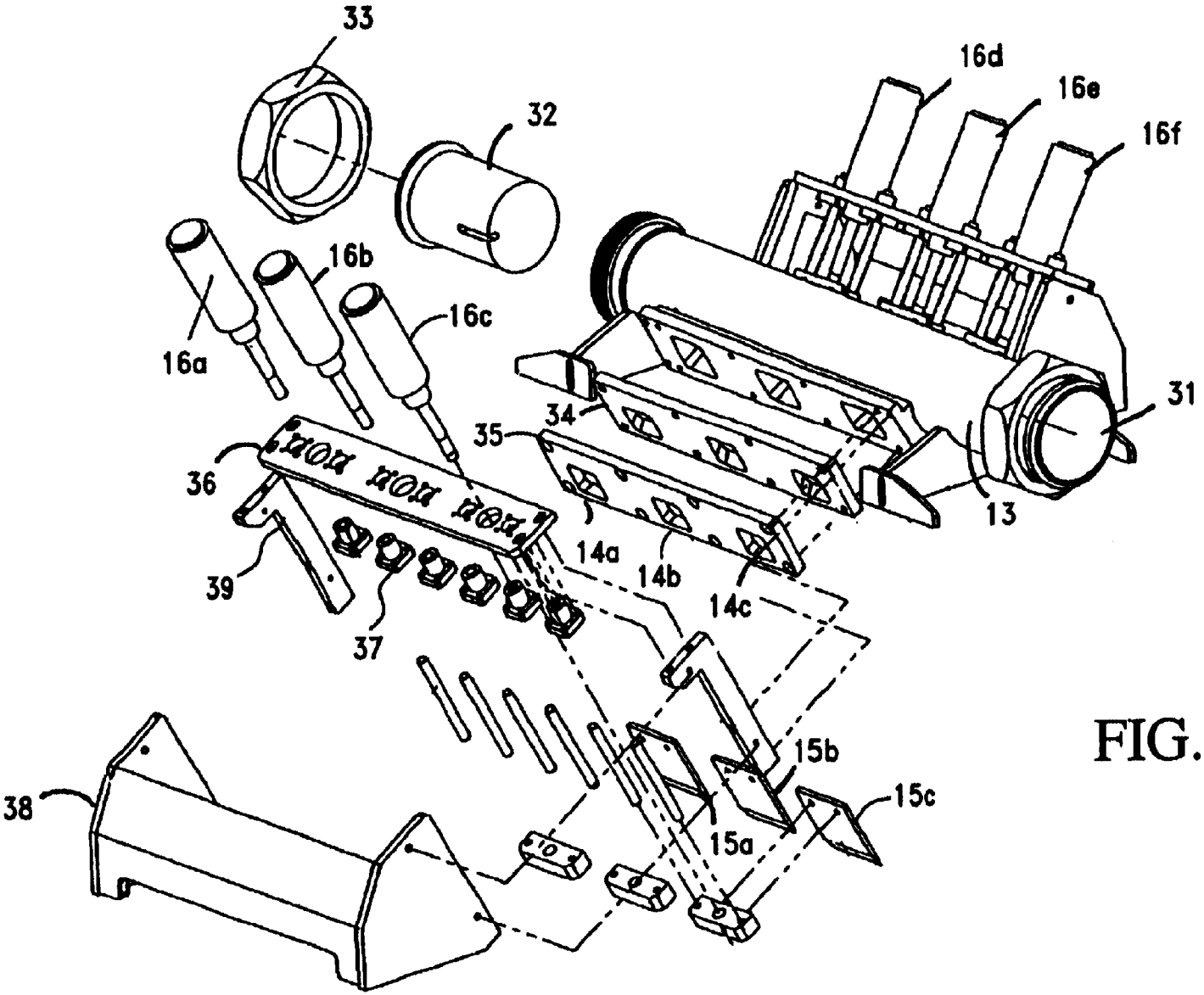
Figure 3:
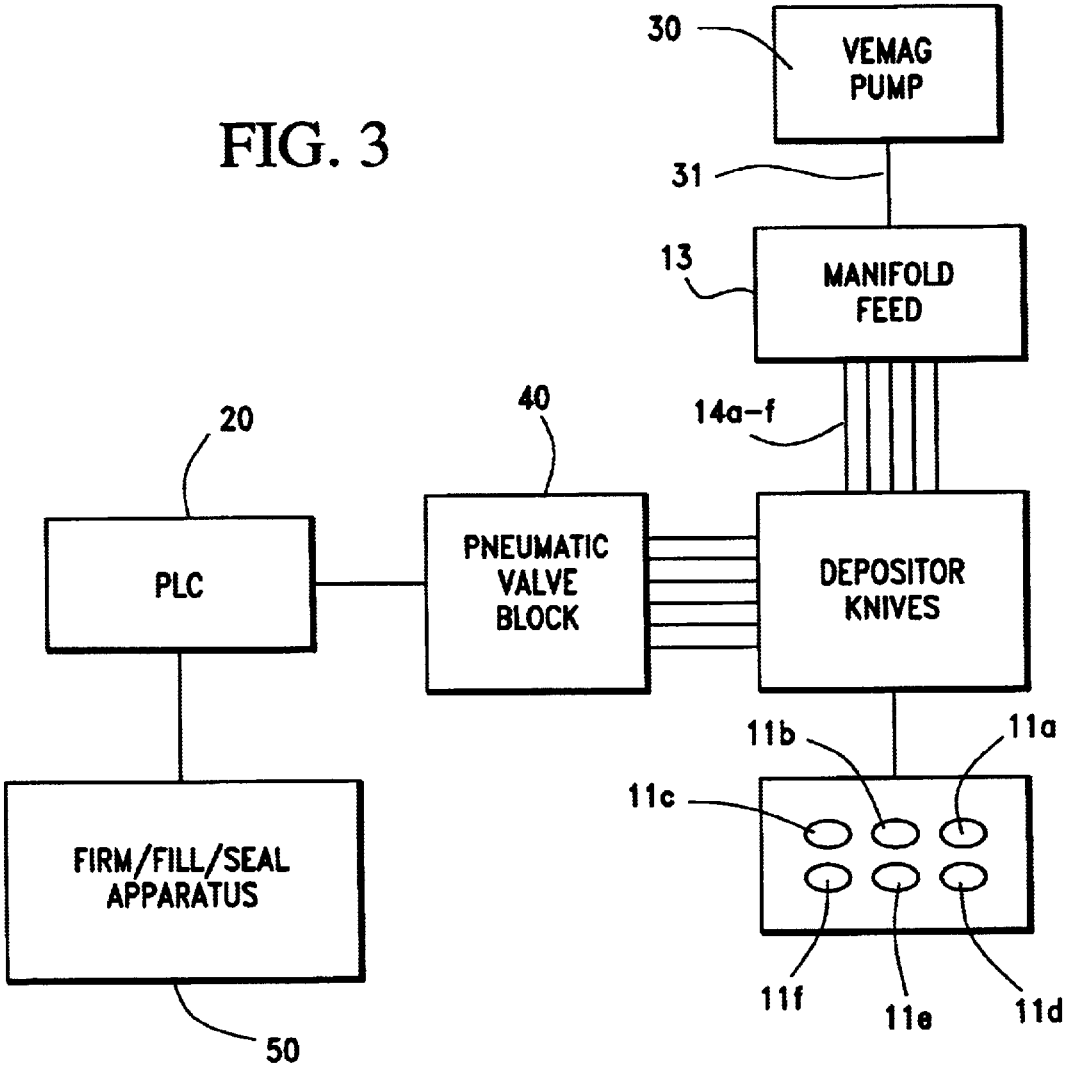
FIG. 3 is a schematic block diagram of the control circuit for the invention.

Referring now to the drawings and particularly FIGS. 1 and 2, the invention comprises a six outlet dual cutoff apparatus 10. The apparatus 10 is used with a conventional form/fill/seal apparatus 50 for portioning and depositing food products into pockets 11*a–f*. In addition to filling the pockets of a horizontal form/fill/seal machine the device may also be used with other packaging machines such as a preformed tray-sealing machine. In this instance the trays are preformed and placed into carriers. Once the food is in the tray, the tray can be evacuated and sealed with film. The purpose of apparatus 10 is the simultaneous scaling and portioning of food products in conjunction with a pump 30 of the Vemag-type manufactured by Robert Reiser & Co., Inc. The filler pump 30 portions once for each pocket 11 to be filled operating in the manner disclosed below. The apparatus 10 provides extremely accurate portions by weight and deposits the portions into pockets 11 in an automatic filling apparatus 50.

The pump outlet 31 is connected to the single cylindrical manifold 13, which has a number of outlets 14*a–f* which correspond to positions over the pockets 11*a–f*. A plurality of pneumatically driven cut-off knives 15*a–f* are mounted over the corresponding manifold outlets 14*a–f*. The knives 15*a–f* are initially in a down position blocking off flow from the manifold outlets 14*a–f*.

When the packaging machine indexes to its next position presenting a new series of pockets 11*a–f* beneath the apparatus 10, a signal is sent to the programmable logic controller (PLC) 20 that operates the pneumatic valve block 40 to control the knives 15*a–f* in a predetermined sequence. The controller 20 initiates a series of operations wherein one knife 15*a* retracts opening manifold outlet 14*a*. The Vemag 30 pumps a single accurate portion through the outlet 14*a* and the knife 15*a* comes down and cuts off the portion cleanly permitting the portion to drop into pocket 11*a*. Next, knife 15*b* opens, the Vemag portions and the knife 15*b* comes down and cuts off the portion cleanly to fill pocket 11*b*. The knives 15*a–f* are driven by pneumatic cylinders 16*a–f* that are operated by PLC 20. This operation continues until the six pockets 11*a–f* are filled. Once the pockets 11*a–f* are filled, the PLC 20 signals the packaging machine that it can index starting a new series of portioning operations.

As a further advantage, the outlets 14*a–f* have at least a 1° angle so that when the knives 15*a–f* run against a corresponding outlet 14*a–f*, the knives 15*a–f* will cut like scissors. Further, it is possible to program in a "double-cut" in the PLC 20. After a knife 15*a–f* has opened and then traveled downward to cut the food product fed through the respective manifold outlet 14*a–f*, the corresponding knives 15*a–f* travel back up approximately 25% of its travel and then closes again. This "double-cut" operation assures that anything that has stuck to a knife 15*a–f* is thrown into the pocket 11*a–f*. This of course also increases weight accuracy and is particularly suitable for use with chicken, which has a sinew problem.

The mechanical details of the apparatus 10 are shown in the partially exploded view of FIG. 2. The manifold 13, which receives product from the Vemag pump 30 through the open end 31 is, capped at the other end by end plug 32 and end nut 33. The manifold outlets 14*a–f* include the shaping gasket 34 and faceplate 35 that mount over corresponding openings in the manifold 13. The cylinders 16*a–f* are mounted through plate 36 and bushings 37 to knives 15*a–f* mounted on the bars 37*a–f*. A cover 38 is mounted to the manifold 13 with cylinder support brackets 39 at each end.

While the invention has been explained by a detailed description of certain specific embodiments, it is understood that various modifications and substitutions can be made in any of them within the scope of the appended claims, which are intended also to include equivalents of such embodiments. For example, while the preferred embodiment shows six-tray pockets 11*a–f*, the depositor 10 could be modified to operate with two or more tray pockets.

What is claimed is:

1. A multi-outlet depositor for portioning and depositing food products within tray pockets on form/fill/seal machines and other food packaging machinery comprises:

a manifold at atmospheric pressure prior to portioning and having a plurality of outlets;

a pump for feeding a predetermined portion of food product from a static mass into the manifold and through the plurality of outlets;

a plurality of knives, each knife blocking an outlet in the manifold;

control means sequentially opening the manifold outlets by retracting the corresponding blocking knife and then cutting the flow of food product after a predetermined pumped amount of food product has passed through the outlet to be deposited in a tray pocket for final package filling by closing the manifold outlet.

2. A multi-outlet depositor in accordance with claim 1 wherein:

the outlets adjacent the knives include a surface having at least a 1° angle with respect to the knives to permit the knives to operate against said surface like a scissor.

3. A multi-outlet depositor in accordance with claim 1 wherein:

the control means moves the knives from a cutting to a down position blocking the flow of food product and then reopens for approximately 25% of its initial travel and then closes again assuring that any product that sticks to a knife is deposited into the pocket.

4. A multi-outlet depositor in accordance with claim 1 wherein:

the tray pockets comprise a plurality of pockets spaced in a predetermined arrangement on a tray and the manifold includes a plurality of outlets mounted above the tray each having a corresponding knife positioned adjacent an outlet.

5. A multi-outlet depositor in accordance with claim 1 further including:

a pneumatic drive system having a plurality of pistons each piston coupled to a knife and operated by the control means.

6. A multi-outlet depositor in accordance with claim 5 wherein:

the control means comprises a programmable logic controller for operating the pneumatic drive system for knives.

7. The method of portioning and depositing food products into tray pockets on form/fill/seal machines, which comprises steps of:

providing a static mass of food product;

providing a manifold having a plurality of outlets;

maintaining each outlet in a closed position with a knife;

opening the manifold outlets in sequence by retracting the corresponding knife;

pumping a predetermined portion of food through open manifold outlets;

closing the outlet by returning the knife to its original position cutting off an accurate portion of food product pumped therethrough; and, depositing the portion of food product into a tray pocket.

8. The method of portioning and depositing food products in accordance with claim 7 further including the step of:

indexing a further tray into position to have food portions deposited into tray pockets when the manifold has filled a first plurality of pockets.

9. The method of portioning and depositing food products in accordance with claim 8 further including the step of:

partially reopening the manifold outlets by partially retracting the knives and performing a double cut on the food product to eliminate any product on the knives.

* * * * *